US006296077B1

(12) United States Patent
Wood et al.

(10) Patent No.: US 6,296,077 B1
(45) Date of Patent: Oct. 2, 2001

(54) STRUCTURAL BRACING CONNECTION SYSTEM

(75) Inventors: Charles Francis Wood, Mississauga; Clarence Pang Sum Au, Thornhill, both of (CA)

(73) Assignee: Superbuild Technology Inc., Thornhill (CA)

( * ) Notice: Subject to any disclaimer, the term of this patent is extended or adjusted under 35 U.S.C. 154(b) by 0 days.

(21) Appl. No.: 09/461,360

(22) Filed: Dec. 15, 1999

(51) Int. Cl.[7] ..... E04G 1/00
(52) U.S. Cl. ..... 182/186.8; 403/49
(58) Field of Search ..... 182/186.8, 186.7, 182/179.1; 403/49

(56) References Cited

U.S. PATENT DOCUMENTS 2,842,408 * 7/1958 Symons .

FOREIGN PATENT DOCUMENTS

815095 * 9/1951 (DE) ..... 182/186.7
53860 * 6/1982 (EP) ..... 182/186.8

* cited by examiner

*Primary Examiner*—Alvin Chin-Shue
(74) *Attorney, Agent, or Firm*—Neil H. Hughes; Ivor M. Hughes; Marcelo K. Sarkis

(57) ABSTRACT

A system of connectors for use in temporary structures to connect the bracing members of open lattice towers and trusses to the legs of towers and chords of trusses and space frames. A connector is permanently fitted to each end of all bracing members. The connector is configured to engage a cylinder (or projection) that is integral to the leg (or chord as the case may be). After one end is engaged on a cylinder (projection) the member is rotated about the engaged end until the connector on the opposing end of the member engages a corresponding cylinder (projection) on the opposed leg or chord. Installation of the next member using the method as described permanently locks the previously installed member in place such that it can not be removed until the member that was installed after it is removed. The assembly sequence is therefore fixed and begins at the bottom of a tower leg or one end of a truss chord. Disassembly requires following a sequence that is exactly the reverse of the assembly sequence. This system of connectors allows rapid installation of bracing members without the use of tools, installation of fasteners, or engagement of additional securing components such as wedges or cams.

4 Claims, 5 Drawing Sheets

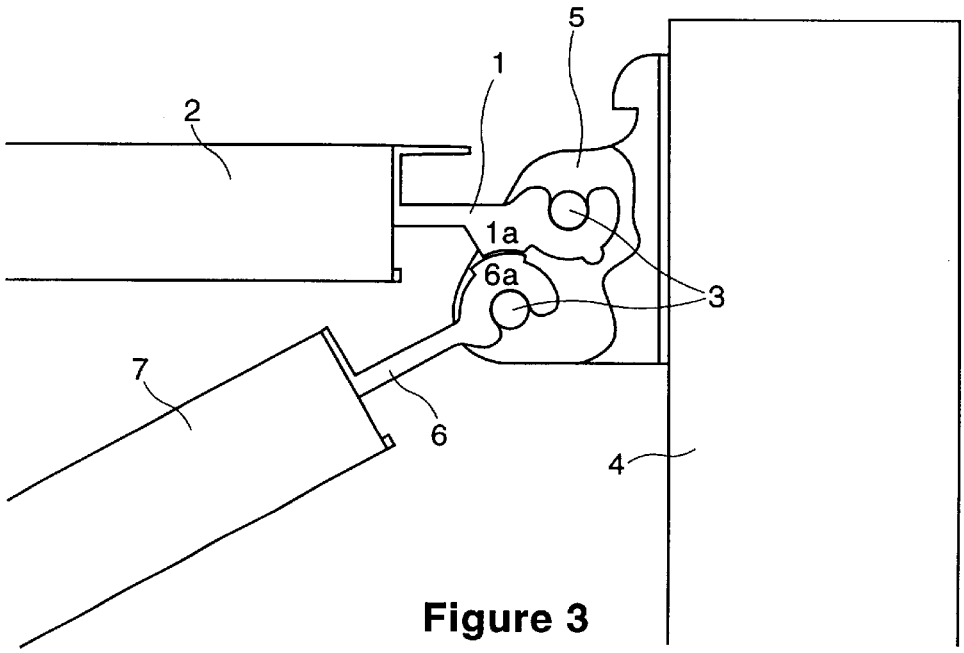
Figure 3
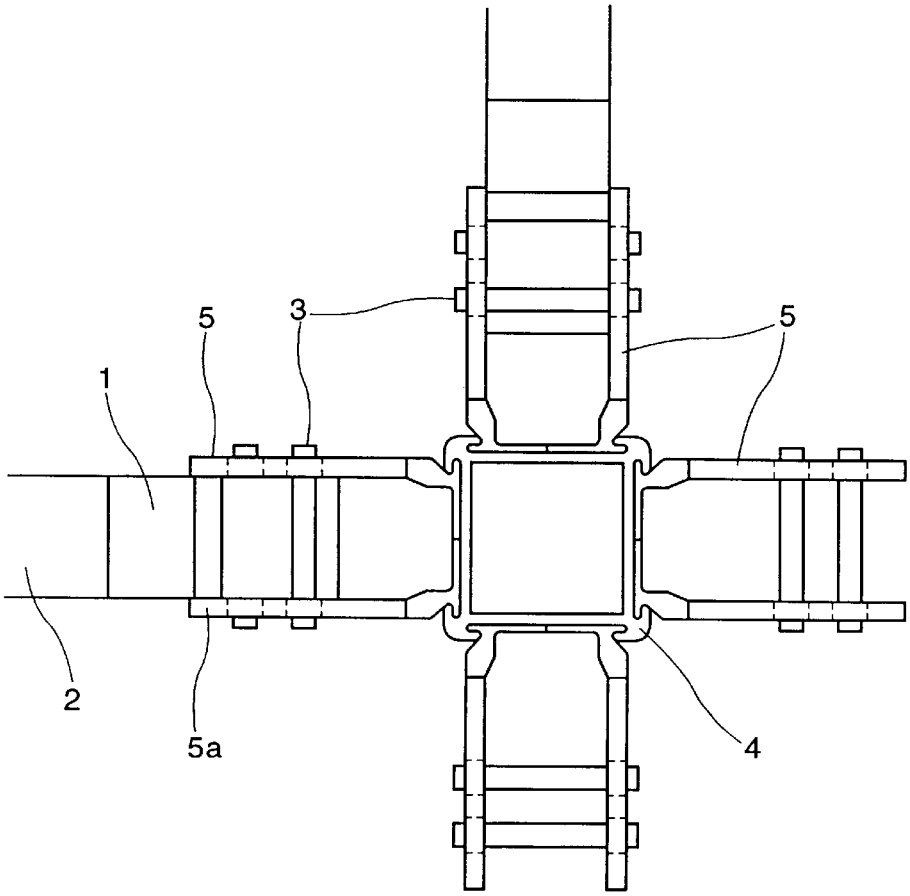
Figure 4 (PLAN)

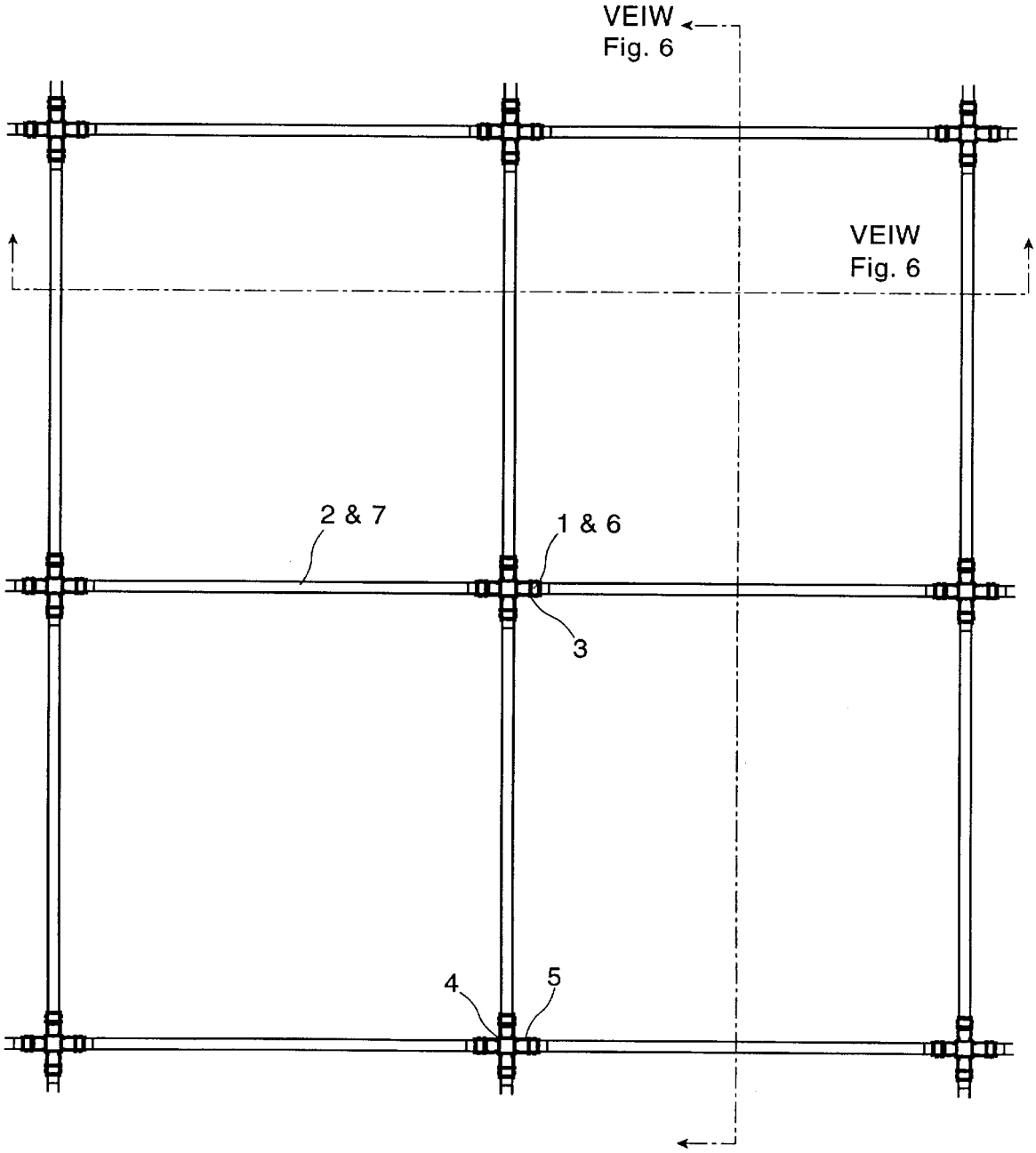
Figure 5 (PLAN)

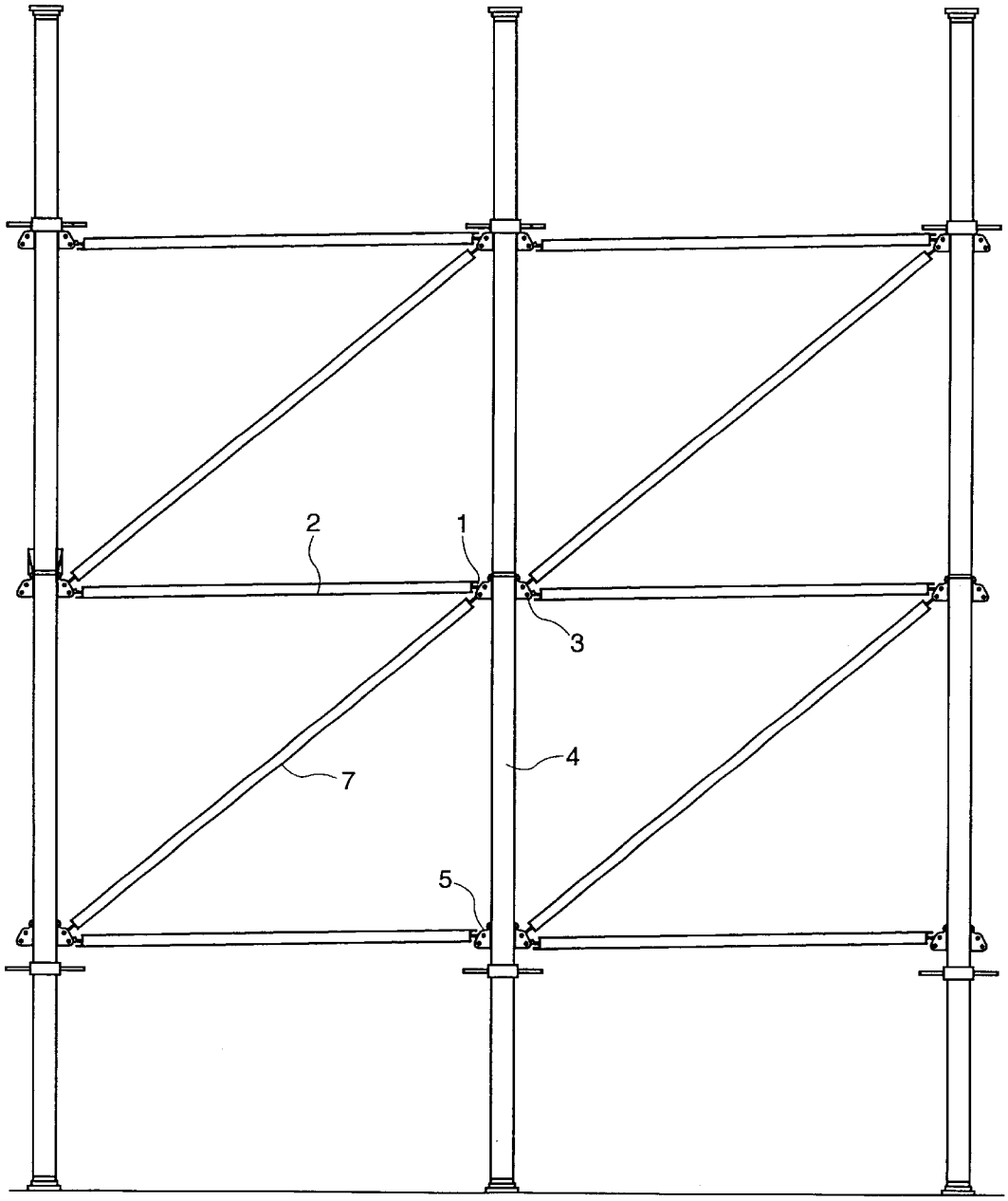
Figure 6 (ELEVATION OF Fig. 5)

INSTALLATION PROCEDURE

STRUCTURAL BRACING CONNECTION SYSTEM

FIELD OF THE INVENTION

This invention relates to structural connections between bracing members and legs/chords in temporary open lattice towers, trusses, and space frames. An example of such towers would be scaffolding/shoring systems.

BACKGROUND OF THE INVENTION

Shoring is in effect scaffolding designed to support high relatively static loads wherein scaffolding normally provides a platform and access for workmen. Scaffolding that uses a number of members in standard lengths that employ unique quickly installed connections is referred to in the industry as "system scaffolding". The connections, that are the subject of this invention, may find application in "system scaffolding/shoring".

Existing "system scaffolds" make use of either wedges, pins, rotating collars or gravity (or spring) actuated latching mechanisms to secure the connections between members. Wedges and rotating collars are most often used. These connections require the use of two hands and a hammer when the system is erected or dismantled. These connection configurations also require the installer (or installers) to position himself within arms reach of each connection to set and hammer the wedge or collar. Similarly, latch and pin systems require the installer to position himself within arms reach of each connection when dismantling and often requires the use of two hands.

The members in system scaffolding are often in the order of 10 ft. long. Further the installer (scaffolder) is most often working at such a height that an accidental fall would result in serious injury and in many cases death. The need to use two hands and to move within arms reach of each connection when erecting and dismantling is a very serious drawback to existing systems, especially in light of the very limited personal security of the installer who must climb and support himself on the structure being erected.

Recognizing the foregoing limitations in the prior art, there exists a long felt need to reduce the risk to the installer and reduce the time needed to erect and dismantle temporary structures by creating an improved connection.

It is therefore a primary object of the invention to provide a scaffolding and shoring system which is simple to manufacture and easy to use and which obviates many of the problems in the prior art.

It is a further object of this invention to provide a connector for scaffolding/shoring members which interfit in the assembled position to provide locking between the members when the superior member is rotated to the assembled position.

It is yet a further object of the invention to provide a scaffolding and shoring system which improves the safety of those assembling the system.

It is yet a further object of the invention to provide a scaffolding and shoring system which is economical.

Further and other objects of the invention will become apparent to those skilled in the art when considering the following summary of the invention and the more detailed description of the preferred embodiments illustrated herein.

SUMMARY OF THE INVENTION

According to one aspect of the invention there is provided a scaffolding and shoring system comprising inter-engaging members connected to a vertical tower leg, said members including an upper (superior) member and a lower (inferior) member, said upper (superior) member of the system when erected inter-engaging with the lower (inferior) members when said upper member is rotated to an assembled position, each of the upper and lower members having two ends and preferably each end including engaging parts which engage upon the rotation of the upper member into its assembled position, thereby providing the desired locking action of the upper member locking the lower member in position as the upper member is rotated to its assembled position. This locking action is accomplished as the scaffolding is erected by the installer thereby minimizing the above-mentioned disadvantages. The connector embodied in the invention is more economical to produce and is considerably simplified as a results of the elimination of parts from known systems.

According to yet another aspect of the invention there is provided a scaffolding/shoring system comprising vertical tower legs, and structural bracing members, each structural bracing member having two ends and having preferably disposed proximate each end mutually cooperating connectors, said connectors for connecting said structural bracing members to the vertical tower legs or the like wherein the bracing members are locked in place by subsequent installation of a second bracing member. Preferably the bracing members can be removed by reversing the procedure. The only moving parts are the members being installed and the members in turn do not make use of moving parts either loose or captive. Preferably the members may be rotated in relation to one another in order to accomplish there inter-engagement which rotation pivots about one end of each member during installation or removal. Preferably the connectors of the system are provided with spoiling elements that ensure each member is installed in turn in the intended orientation.

A system of connectors for use in temporary structures to connect the bracing members of open lattice towers and trusses to the legs of towers and chords of trusses and space frames is provided. An example of such towers would be scaffolding/shoring systems. A connector is permanently fitted to each end of all bracing members. The connector is configured to engage a cylinder (or projection) that is integral to the leg (or chord as the case may be). After one end is engaged on a cylinder (projection) the member is rotated about the engaged end until the connector on the opposing end of the member engages a corresponding cylinder (projection) on the opposed leg or chord. Installation of the next member using the method as described permanently locks the previously installed member in place such that it can not be removed until the member that was installed after it is removed. The assembly sequence is therefore fixed and begins at the bottom of a tower leg or one end of a truss chord. Disassembly requires following a sequence that is exactly the reverse of the assembly sequence. This system of connectors allows rapid installation of bracing members without the use of tools, installation of fasteners, or engagement of additional securing components such as wedges or cams. Please refer to FIG. 7 in this regard.

According to yet another aspect of the invention there is provided a joint for interconnecting structural bracing members comprising at least a first and second structural bracing member each having two ends and having mutually cooperating locking connectors fitted thereto proximate each end and for connecting said at least a first and second structural bracing member to compatible connectors disposed on legs/chords of one of a group of systems selected from the group of systems including towers, trusses and space frames, wherein the first bracing member is locked in place by said mutually cooperating locking connectors during the subsequent installation of the second bracing member.

Preferably said bracing members can be removed by reversing the procedure. The only moving parts are the members being installed and the members in turn do not make use of moving parts either loose or captive.

The members may be rotated in relation to one another in order to accomplish their inter-engagement which rotation pivots about one end of each member during installation or removal. The connectors of the joint may be provided with spoiling elements that ensure each member is installed in turn in the intended orientation.

BRIEF DESCRIPTION OF THE DRAWINGS

The following six figures illustrate the preferred embodiments of the invention and show how the invention would be typically applied to shoring towers and similar structures.

FIG. 3 illustrates the details of the shapes of a pair of cooperating connectors and their relative positions as they mutually lock one another in place when the second member is installed (the horizontal in this case) at the upper end of a diagonal and a horizontal joint shown in a preferred embodiment of the invention.

FIG. 4 is a view from above the connection arrangement in FIG. 3 with the addition of three more brackets 5 shown in a preferred embodiment of the invention.

FIG. 5 is a view from above of a multi-legged tower that employs the invention shown in a preferred embodiment of the invention.

FIG. 6 illustrates a side view of the multi-leg tower identified in FIG. 5 shown in a preferred embodiment of the invention.

DETAILED DESCRIPTION OF THE DRAWINGS

Figure 1:
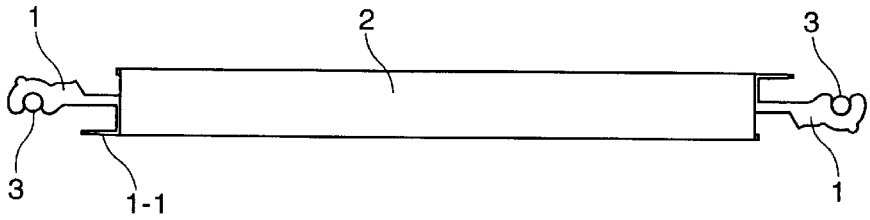
FIG. 1 illustrates a horizontal bracing member engaging cylindrical projections at each end shown in a preferred embodiment of the invention.
Figure 2:
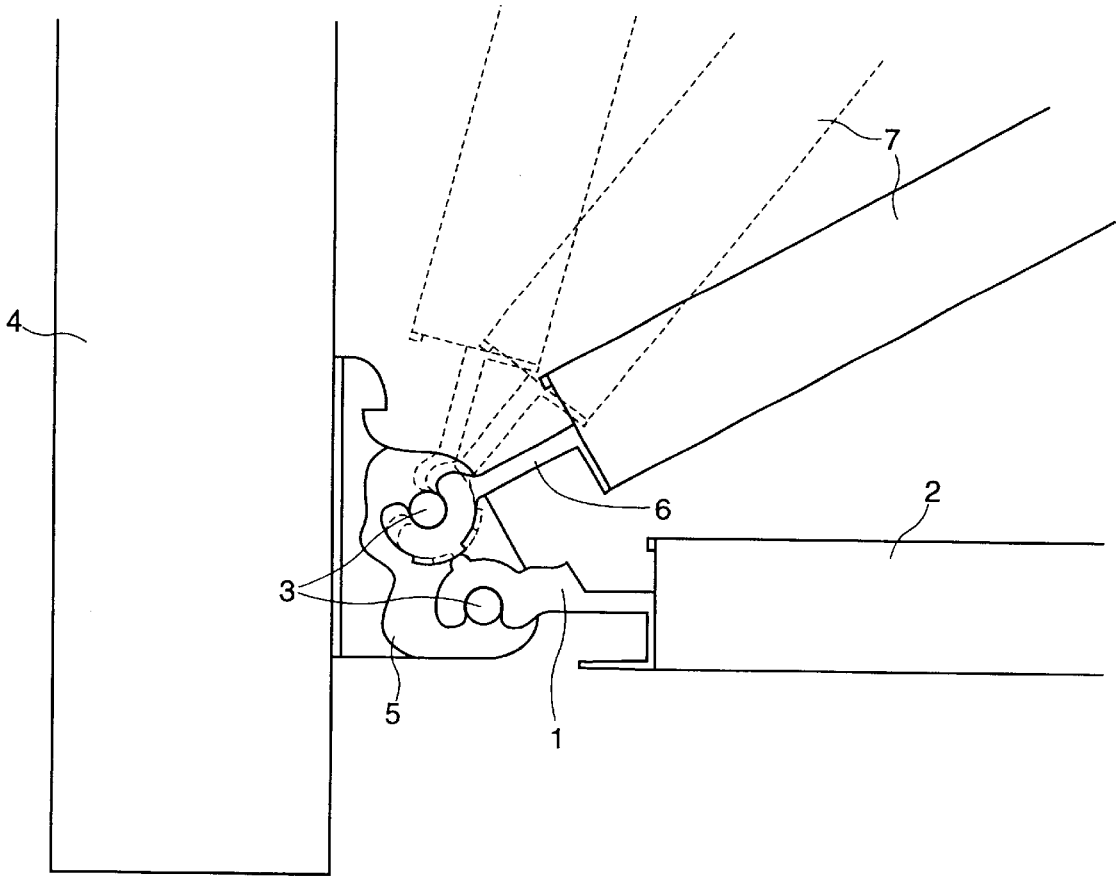
FIG. 2 illustrates the manner in which the rotation of the bracing member effects engagement of the member's connector with the cylindrical projections attached to tower legs or truss chords shown in a preferred embodiment of the invention.

Referring generally to the figures the cooperating connectors attached to structural bracing members are illustrated in FIG. 1, wherein two connectors 1 permanently attached to the body of the member 2 engage cylindrical projections 3 shown in FIG. 2. The body 2 is commonly a tube but could also be any structural element capable of carrying a tension and/or compression load. We expect that the use of know methods of attachment for connectors 1 to body 2 such as mechanical fasteners or adhesive welding and other fastening methods would work just as well. In one embodiment shaping the ends of a member 2 by known methods can be utilized to create connectors that are integral to the member.

The cylindrical projection 3 permanently attached to a tower leg 4 (or truss chord) via bracket 5 found in FIGS. 2 through 6, is shown as a pin or bolt. This cylindrical projection could be an integral part of the bracket 5 that in turn could be a casting, forging, metal pressing, or welded attachment all of which would serve the intent of the invention equally well. The bracket provides a constraining flange (end stop) at each end of the cylindrical projection such that movement of the connectors along the axis of the cylindrical projection is limited to clearances required for easy installation and removal of the connectors. A constraining flange 5*a* (as best seen in FIG. 4 has been partially removed ) on one side in FIGS. 2 and 3 for the sole purpose of providing a view of the connectors.

FIGS. 4 and 5 illustrate how a tower is constructed in three dimensions as more than one bracket 5 is normally fitted to a leg 4 to allow for the assembly of more complex structures such as the multi-leg tower in FIG. 5 and related sections in FIG. 6.

Figure 7:
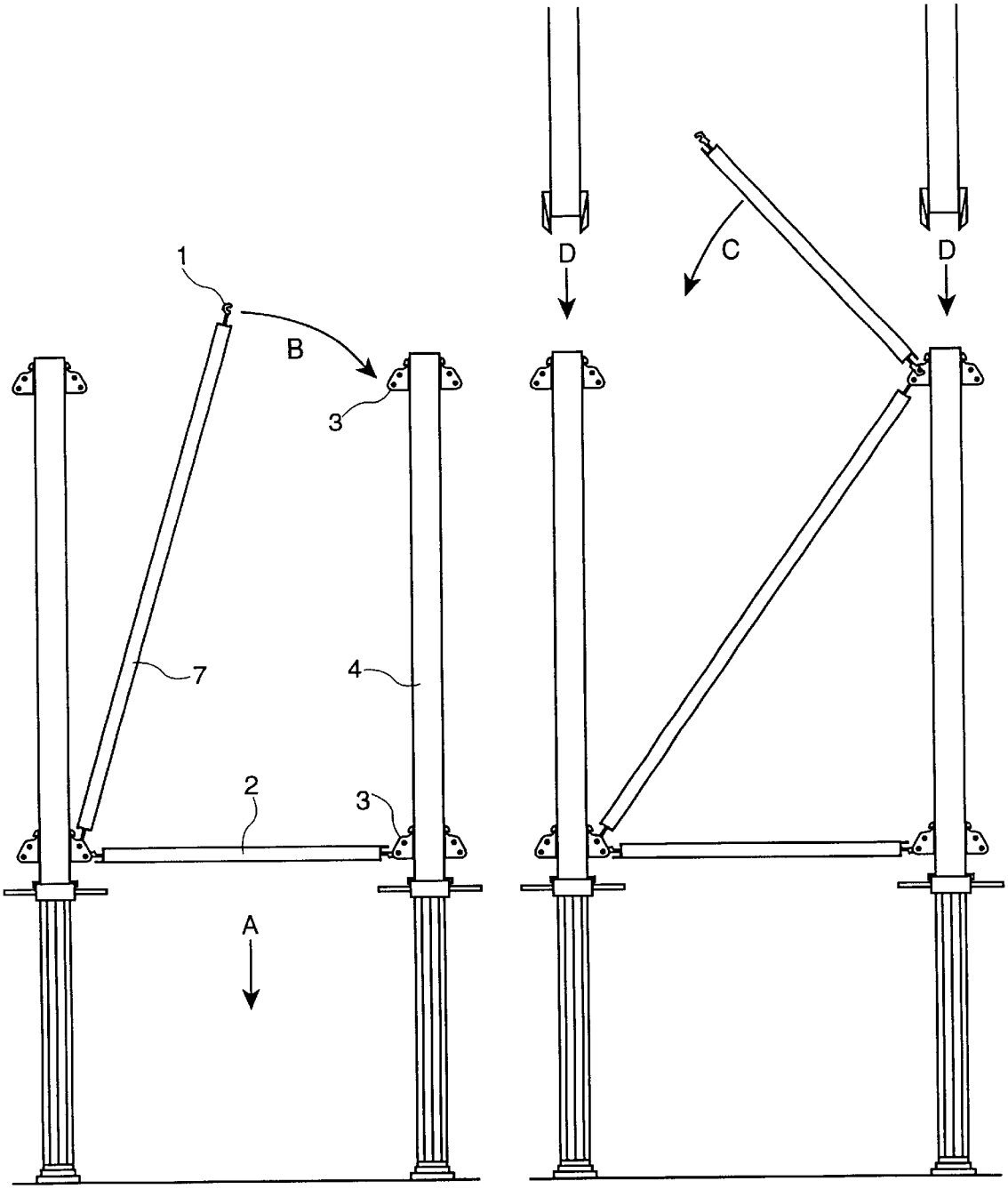
FIG. 7 is a schematic view of the elements of the system in the manner in which they are interconnected.

FIG. 7 illustrates a schematic view of the elements of the system in the manner in which they are interconnected.

In the preferred embodiment shown in the figures, the connectors 7 best seen in FIGS. 2 and 3 for the diagonals are not exactly the same as connectors 1 (FIG. 1) on the horizontals even though geometrically similar. The configuration of the cooperating connectors is defined so as to provide inter-engagement when they are installed in there respective assembled positions on two adjacent cylindrical projections 3 to allow for the necessary clearances between the connectors 1 and cylindrical projection 3 while maintaining the ability of the connectors to mutually lock in place when assembled as the superior member is rotated to its assembled position as shown by FIGS. 2 and 3. At that position the portions 1*a* and 6*a* inter-engage and prevent disassembly until the superior member is rotated to its disassembled position. Actual dimensions of parts may vary from installation to installation to accommodate different specific applications and related structural dimensions. Further, to make it difficult or impossible for the members to be installed incorrectly, "spoiler elements", such as the projection 1-1 that is part of the horizontal connector 1, may be added. Spoiler element 1-1 is provided to ensure the horizontal member is not installed upside down (the installer will find the spoiler element will interfere with the previously installed connector if an incorrect installation is attempted).

The advantages realized by such a system are set out below.

- An installer positioned near a leg or chord connection point can engage the end of a bracing member to the connection point he is near and allow the member to rotate and engage the connection point on the opposite leg/chord without moving to that other position.
- The installer does not need to carry or use a tool to secure the connections when erecting and dismantling.
- The installer needs to use only one hand when erecting or dismantling leaving the other hand to improve his personal security.
- The risk of installer error is reduced because he does not have to perform a secondary securing operation that could be accidentally omitted that would jeopardize the safety of the completed structure.
- The connections are specially configured to make it very difficult (well nigh impossible) for the installer to secure a member incorrectly (upside down or connect the wrong end to a specific connection point). This secondary feature (not mandatory) further decreases the risk of incorrect installation.
- Due to the interlocking feature of the members, an individual member can not be removed once the structure is completed improving reliability of the structure (it is common practice for users of scaffolding to remove members if their presence is found inconvenient other than finding safer solutions).

The installer does not have to get within arms reach of any connection to secure it (3–4 ft. is most often close enough to make the connection closest to the erector and the connection on the other end can be up to 10 ft. away).

The reduction in complexity of the connection not only reduces the cost of manufacture but improves reliability and life through the elimination of the more fragile locking elements found in other connector systems.

Shoring towers are often assembled in a horizontal position and lifted into a vertical position after assembly. It is therefore important that the bracing member locking device not be sensitive to the orientation of the structure as is the case with this invention and not the case with gravity operated locks.

A system of connectors for use in temporary structures to connect the bracing members of open lattice towers and trusses to the legs of towers and chords of trusses and space frames is provided. An example of such towers would be scaffolding/shoring systems. A connector is permanently fitted to each end of all bracing members. The connector is configured to engage a cylinder (or projection) that is integral to the leg (or chord as the case may be). After one end is engaged on a cylinder (projection) the member is rotated about the engaged end until the connector on the opposing end of the member engages a corresponding cylinder (projection) on the opposed leg or chord. Installation of the next member using the method as described permanently locks the previously installed member in place such that it can not be removed until the member that was installed after it is removed. The assembly sequence is therefore fixed and begins at the bottom of a tower leg or one end of a truss chord. Disassembly requires following a sequence that is exactly the reverse of the assembly sequence. This system of connectors allows rapid installation of bracing members without the use of tools, installation of fasteners, or engagement of additional securing components such as wedges or cams. FIG. 7 is a schematic view of the elements of the system in the manner in which they are interconnected. It can be clearly seen that elements 2, 4 and 7 may be rotated/assembled in directions A, B, C, D, to assemble the system. As many changes may be made to the preferred embodiments without departing from the scope of the invention; it is intended that all material contained herein be interpreted as illustrative of the invention and not in a limiting sense.

The embodiments of the invention in which an exclusive property or privilege is claimed are as follows:

1. A scaffolding and shoring system comprising inter-engaging members connected to a vertical tower leg, said members including an upper (superior) member and a lower (inferior) member, said upper (superior) member of the system when erected inter-engaging with the lower (inferior) member when said upper member is rotated to an assembled position, each of the upper and lower members having two ends and having disposed proximate each end cooperating connectors having mutually locking parts, spaced upper and lower projections on said vertical tower leg, the connector of the lower member engaging the lower projection and the connector of the upper member engaging the upper projection, upon rotation of the upper member about the engaged upper projection the locking part of the upper member connector engages the locking part of the lower member connector, thereby providing a desired locking action of the upper member locking the lower member in position as the upper member is rotated to its assembled position.

2. A scaffolding/shoring system comprising vertical tower legs, and structural bracing members, each structural bracing member having two ends and having disposed proximate each end cooperating connectors having mutually locking parts, said connectors for connecting said structural bracing members to the vertical tower legs and for mutually locking said structural bracing members spaced upper and lower projections on said vertical tower legs, the connector of a lower member engaging the lower projection and the connector of an upper member engaging the upper projection, upon rotation of the upper member about the engaged upper projection the locking part of the upper member connector engages the locking part of the lower member connector, wherein each of the bracing members are locked in place by subsequent installation of a second bracing member.

3. The structure of claim 2 wherein said structural bracing members are unlocked by subsequent removal of a second bracing member.

4. The structure of claim 1 or 2 wherein the connectors of the system further comprise spoiling elements disposed proximate each of the connectors that ensure each member is installed in turn in its intended orientation.

* * * * *